US006022193A

United States Patent [19]

Dubois et al.

[11] Patent Number: 6,022,193

[45] Date of Patent: Feb. 8, 2000

[54] PROPELLER ASSEMBLY FOR AN UNDERWATER DEVICE

[75] Inventors: Neil J. Dubois, Cranston; Robert J. Obara, Portsmouth, both of R.I.

[73] Assignee: The United States of America as represented by the Secretary of the Navy, Washington, D.C.

[21] Appl. No.: 09/090,328

[22] Filed: May 22, 1998

[51] Int. Cl.[7] ..... A47C 7/74

[52] U.S. Cl. ..... 416/169 R; 416/196 R

[58] Field of Search ..... 416/153, 169 R, 416/194, 195, 196 R

[56] References Cited

U.S. PATENT DOCUMENTS

| | | | |
|---|---|---|---|
| 1,014,164 | 1/1912 | Menke | 416/169 R X |
| 1,516,681 | 11/1924 | Palmer | 416/169 R X |
| 1,723,925 | 8/1929 | Fairchild | 416/169 R X |
| 2,523,197 | 9/1950 | Daland | 416/169 R X |
| 2,851,024 | 9/1958 | Meeder | 416/169 R X |
| 2,947,364 | 8/1960 | Haworth | 416/169 R X |
| 5,921,753 | 7/1999 | Ames | 416/169 R |

FOREIGN PATENT DOCUMENTS

| | | | |
|---|---|---|---|
| 333469 | 8/1930 | United Kingdom | 416/169 R |

*Primary Examiner*—John E. Ryznic
*Attorney, Agent, or Firm*—Michael J. McGowan; James M. Kasischke; Prithvi C. Lall

[57] ABSTRACT

In an underwater device adapted to sink in water, the device having a propeller disposed in a tail cone portion thereof and operable to rotate in a first direction to move the device toward a surface of the water, an assembly for preventing the propeller from rotating in a second direction during the sinking of the device in the water. The assembly includes a circular shroud fixed to outboard tips of blades of the propeller and encircling the propeller. A ramp is disposed on an outside surface of the shroud. A tail cone ring is fixed to the tail cone portion and surrounds the shroud. A pivotally movable flap is mounted on an inside surface of the tail cone ring. The ramp and the flap are engageable and configured to prevent rotation of the shroud, and thereby the propeller, in the second direction, and to permit rotation of the shroud, and thereby the propeller, in the first direction.

16 Claims, 4 Drawing Sheets

PROPELLER ASSEMBLY FOR AN UNDERWATER DEVICE

STATEMENT OF GOVERNMENT INTEREST

The invention described herein may be manufactured and used by or for the Government of the United States of America for Governmental purposes without the payment of any royalties thereon or therefor.

BACKGROUND OF THE INVENTION (1) Field of the Invention

The invention relates to means for preventing a propeller on a device subject to free-fall from rotating in a reverse direction during such free-fall, and more specifically to a propeller assembly in an underwater device having stop means for preventing reverse rotation of the propeller during sinking of the device in water.

(2) Description of the Prior Art

Underwater devices, such as acoustic countermeasure devices, are known which utilize a drive motor and propeller system for transiting and/or hovering in a water environment. During an ascent or in hovering, the propeller provides the thrust required to cause the device to rise, or refrain from sinking. During descent, however, the drive motor is off and the device sinks until buoyant forces on the device are balanced. It is during descent that the propeller typically is driven in the reverse direction by forces generated as the water flows over the propeller. Such reverse rotation of the propeller causes the electric drive motor to act as a generator, creating a back electromotive force, which can be problematic when the motor subsequently is energized. High current spikes can develop, causing burn-out of electronics. Further, delays can occur in the motor speed coming up to the desired level. Such problems have been addressed by the provision of additional electronics, which add to the cost and complexity of the device. Thus, there is a need for a relatively simple and inexpensive mechanical solution to the reverse rotation problem in acoustic countermeasure devices, and the like.

SUMMARY OF THE INVENTION

It is, therefore, an object of the invention, to provide in an underwater device adapted to sink in water and having a propeller of or driving the vehicle toward the surface of the water, an inexpensive mechanical assembly for preventing reverse rotation of the propeller during the sinking of the device.

Accordingly, the present invention is applied to an underwater device adapted to sink in water, wherein the device has a propeller which rotates in a first direction to move the device. The invention is an assembly for preventing the propeller from rotating in a second direction when the device is moving against the direction of powered motion. The assembly comprises a circular shroud fixed to outboard tips of blades of the propeller and encircling the propeller, a ramp disposed on an outside surface of the shroud, a tail cone ring fixed to the tail cone portion and surrounding the shroud, and a pivotally movable flap mounted on an inside surface of the tail cone ring. The ramp and the flap are engageable and configured to prevent rotation of the shroud, and thereby the propeller, in the second direction, and to permit rotation of the shroud, and thereby the propeller, in the first direction.

The above and other features of the invention, including various novel details of construction and combinations of parts, will now be more particularly described with reference to the accompanying drawings and pointed out in the claims. It will be understood that the particular device embodying the invention is shown by way of illustration only and not as a limitation of the invention. The principles and features of this invention may be employed in various and numerous embodiments without departing from the scope of the invention.

BRIEF DESCRIPTION OF THE DRAWINGS

Reference is made to the accompanying drawings in which is shown an illustrative embodiment of the invention, from which its novel features and advantages will be apparent.

In the drawings.

DESCRIPTION OF THE PREFERRED EMBODIMENT

Figure 1:
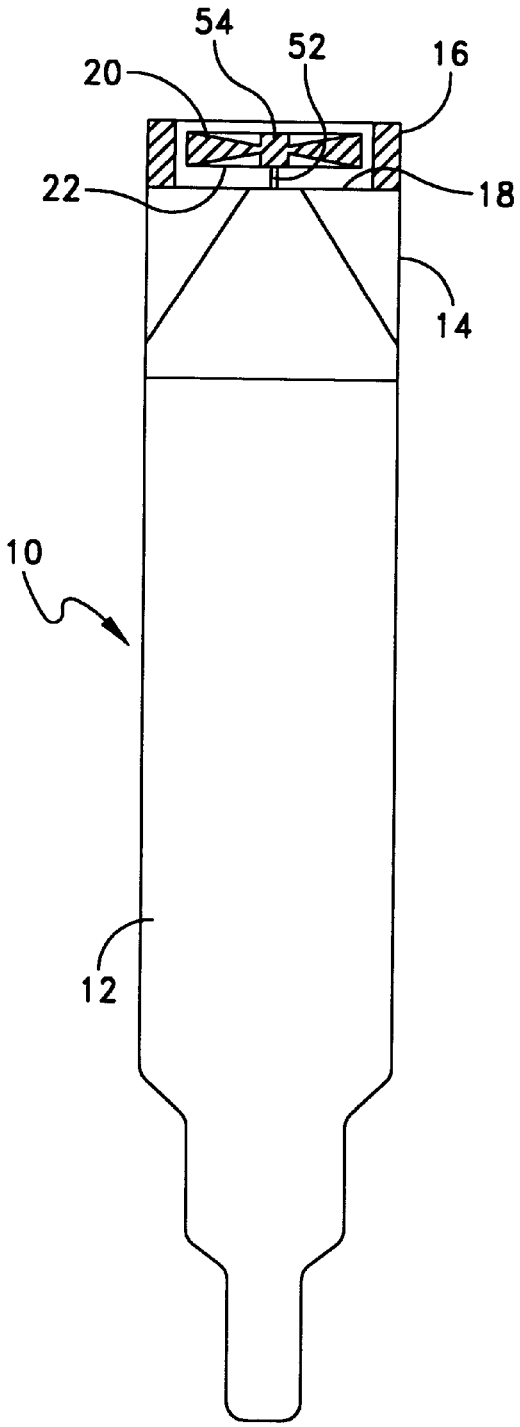
FIG. 1 (PRIOR ART)
FIG. 1 is a side elevational, partly sectional, view of a prior art underwater device of the type with which the inventive assembly is used.
Figure 2:
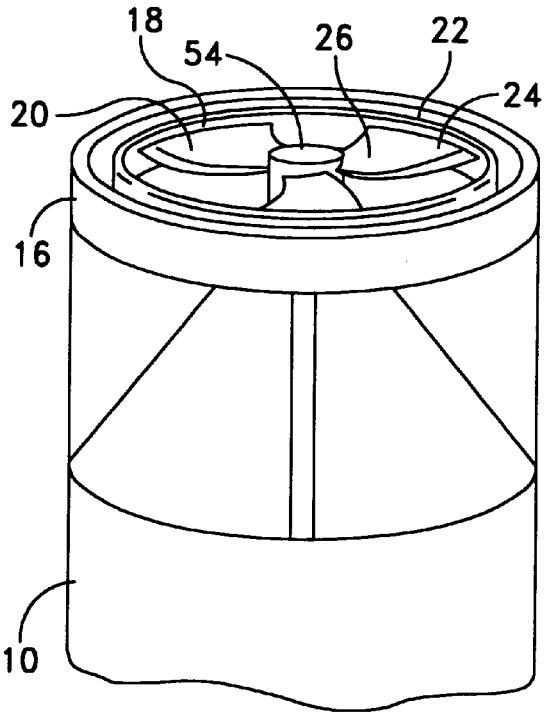
FIG. 2 (PRIOR ART)
FIG. 2 is an enlarged perspective view of a tail cone portion of the device of FIG. 1, showing one form of propeller assembly illustrative of an embodiment of the invention.

Referring to FIG. 1, it will be seen that an illustrative underwater device 10 includes a body portion 12 and a tail cone portion 14. The tail cone portion 14 includes a tail cone ring 16 which, in part, defines an aft recess 18 in which is mounted a propeller 20. A circular shroud 22 is fixed to outboard tips 24 of blades 26 of propeller 20, and encircle propeller 20.

Figure 4:
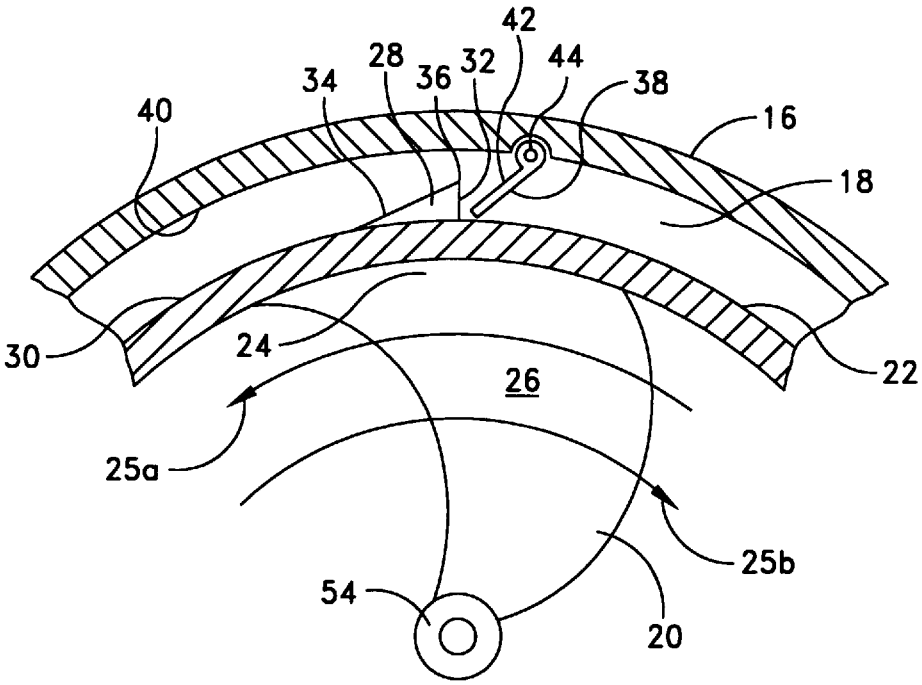
FIG. 4 is a top plan view of a portion of one form of propeller assembly further illustrative of an embodiment of the invention.
Figure 5:
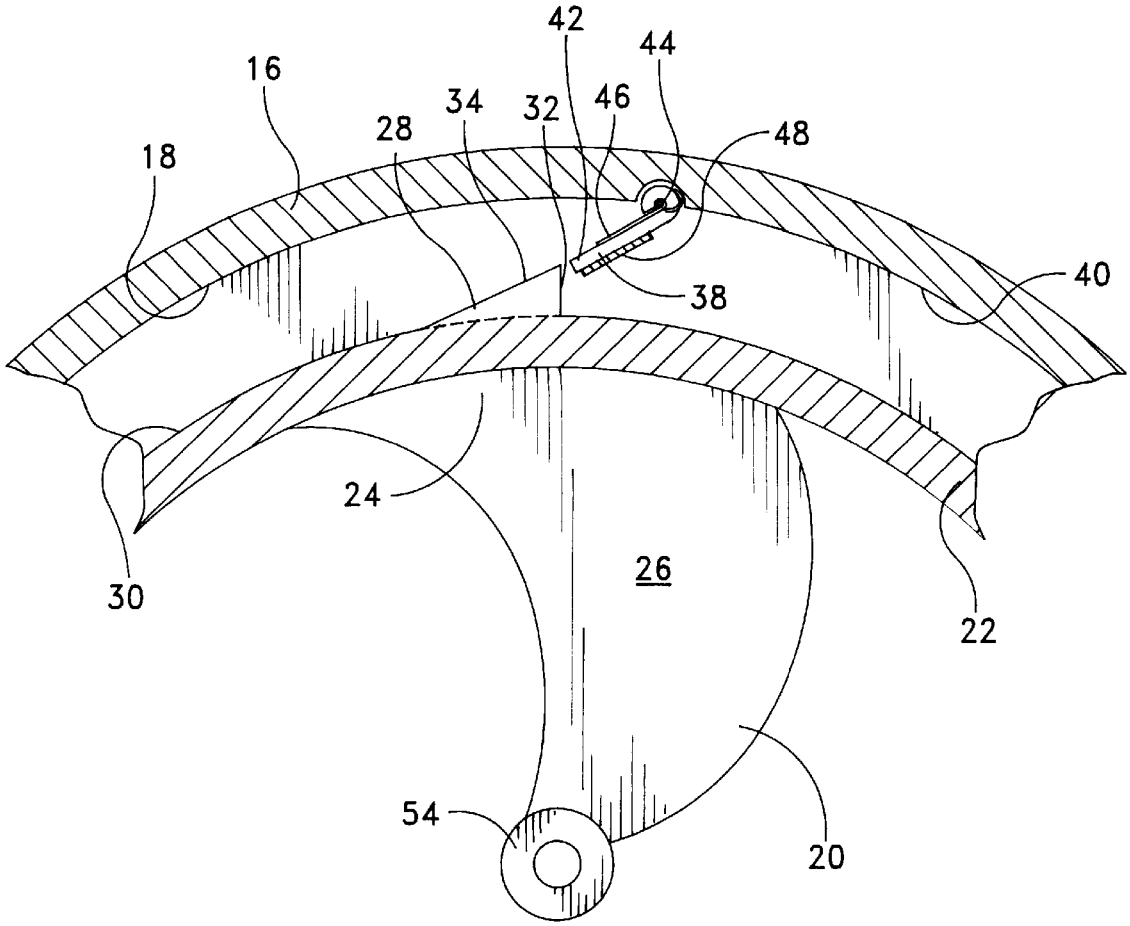
FIG. 5 is an enlarged view of the assembly shown in FIG. 4 and illustrative of further features of the invention.

Referring to FIGS. 4 and 5, it will be seen that a saw-tooth configured ramp 28 is disposed on an outside surface 30 of shroud 22. The ramp 28 includes a first surface 32 extending substantially radially outwardly from shroud 22, and a second surface 34 inclined from an outer end 36 of the first surface 32 to the outside surface 30 of shroud 22.

A pivotally movable flap 38 is mounted on an inside surface 40 of tail cone ring 16. The flap 38 includes a hinge member 42 pivotally mounted on a pin 44 disposed in tail cone ring 16, and a spring 46 biasing hinge member 42 toward a position in which hinge member 42 is engagable by ramp 28. In an alternative embodiment of hinge member 42, shown as FIG. 5, the hinge member further includes an elastomeric pad 48 for contacting with ramp second surface 34. This elastomeric pad 48 will absorb some of the shock of hinge member 42 contacting ramp 28. The pad 48 may, alternatively or additionally, be placed on ramp second surface 34.

Figure 3:
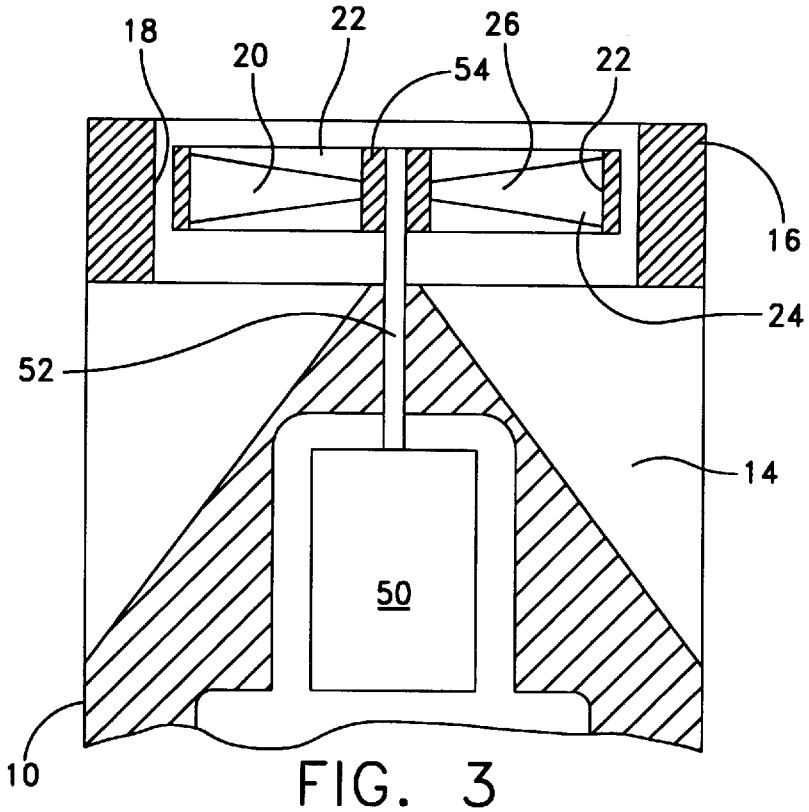
FIG. 3 (PRIOR ART)
FIG. 3 is a sectional view of the tail cone portion of FIG. 2.

A drive motor 50, shown diagrammatically in FIG. 3, is mounted in the device and connected by a drive shaft 52 to a hub 54 on which is fixed propeller 20.

When the device 10 is deployed beneath the surface, and it is desired to raise the device, motor 50 is activated to turn drive shaft 52, and thereby propeller 20 and shroud 22 in a first direction, the powered rotation shown in FIG. 4 as arrow 25*a*. In this mode of operation, the ramp second surface 34 engages the flap 38 which readily pivots to give way and allow ramp 28 to pass. The pad 48 shown in the embodiment of FIG. 5 facilitates quiet operation.

When the device 10 is initially deployed, or when it is desired to lower the level of the device, the power to motor 50 is stopped, permitting the device to sink. During descent of the device, propeller 20 is urged to turn in a second direction by hydrodynamics, shown in FIG. 4 as arrow 25*b*. Turning in this direction causes ramp first surface 32 to engage flap 38 to stop movement of ramp 28, and thereby propeller 20.

Thus, in the first, powered, direction 25*a*, rotation of the propeller is unimpeded by the ramp and flap arrangement. However, turning of the propeller 20 in the second direction 25*b* is quickly halted by the ramp and flap arrangement.

Figure 6:
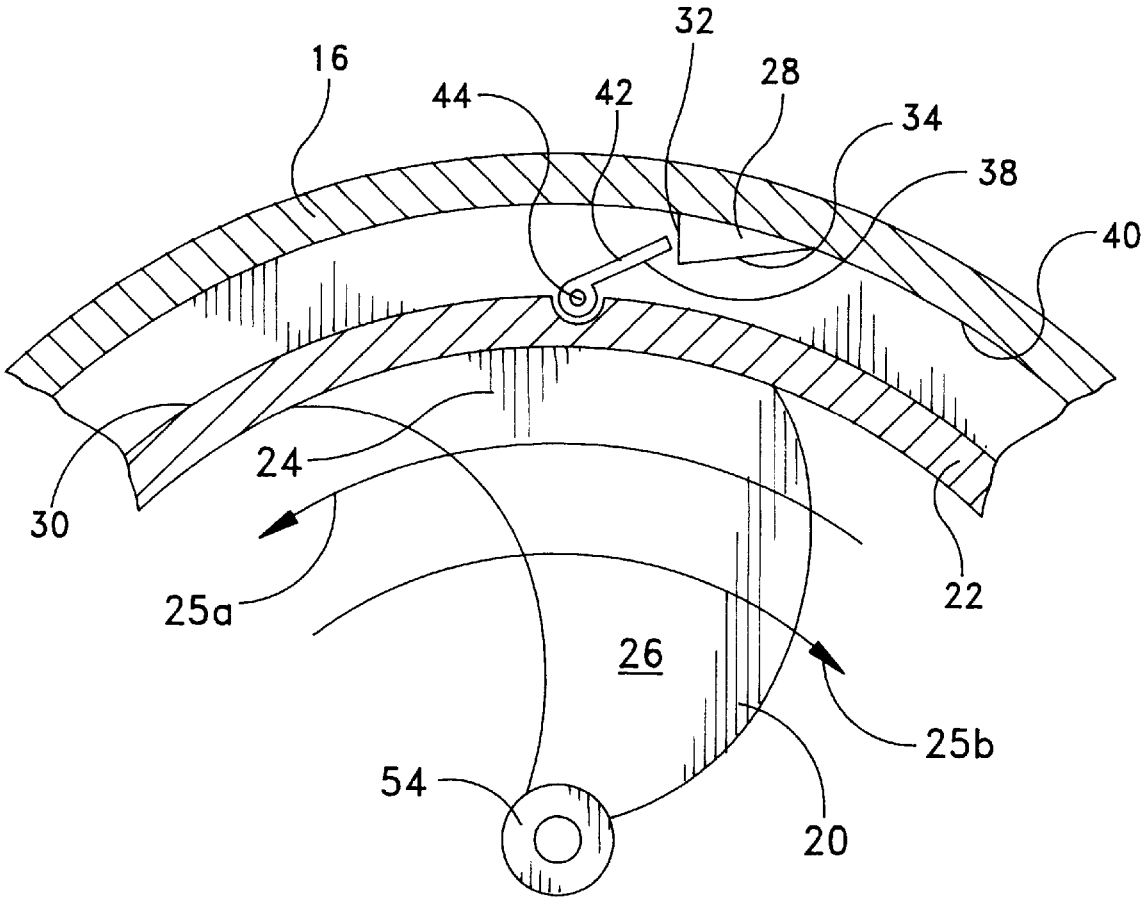
FIG. 6 is similar to FIG. 5 but illustrative of an alternative embodiment.

In FIG. 6 there is shown another embodiment of the current invention wherein the pivotally movable flap 38 is positioned on shroud 22, and ramp 28 is positioned on tail cone ring 16. Flap 38 can be oriented such that hinge pin 44 leads hinge member 42 in the direction of powered rotation 25*a*. Fluid forces impinging on the surface of hinge member 42 keep flap 38 flattened against shroud 22 during powered rotation and counteract centrifugal forces induced by the rotation. During hydrodynamic free flow rotation 25*b*, centrifugal forces and fluid forces work together on flap 38 to move it outward where it will interfere with ramp 28 and stop induced rotation 25*b* of propeller 20. A spring may also be added to flap 38, as in FIG. 5, to assist extension of flap 38 or retraction of flap 38. When the forces are properly balanced, this embodiment offers advantages because the flap 38 does not impact ramp 28 and causes less turbulence during powered rotation. Furthermore, ramp 28 induces less turbulence because it does not move through the water during powered rotation. Either, or both, of the ramp surface 34 and hinge member 42 may be provided with the aforementioned pad 48 shown in FIG. 5.

There is thus provided a simple, inexpensive mechanical assembly for preventing reverse rotation of a propeller mounted in a device wherein free fall of the device normally would cause reverse rotation.

It will be understood that many additional changes in the details, materials, steps and arrangement of parts, which have been herein described and illustrated in order to explain the nature of the invention, may be made by those skilled in the art within the principles and scope of the invention as expressed in the appended claims.

What is claimed is:

1. A counter-rotation preventing assembly for a rotating vehicle propeller, said assembly comprising:

a circular shroud fixed to outboard tips of blades of said propeller;

a ramp disposed on an outside surface of said shroud;

a tail cone ring fixed to said vehicle and surrounding said shroud; and a pivotally movable flap mounted on an inside surface of said tail cone ring;

said ramp and said flap being engageable and configured to permit rotation of said shroud, and thereby said propeller, in a first direction and to prevent rotation of said shroud, and thereby said propeller, in a second direction.

2. The assembly in accordance with claim 1 wherein said ramp comprises a saw-tooth configured ramp.

3. The assembly in accordance with claim 2 wherein said ramp includes a first surface extending substantially radially outwardly from said shroud, and a second surface inclined from an outer end of said first surface to said outside surface of said shroud.

4. The assembly in accordance with claim 3 wherein during fluid motion about said vehicle, said propeller is urged in said second direction whereupon said ramp first surface engages said flap to stop rotative movement of said shroud and said propeller.

5. The assembly in accordance with claim 3 wherein said assembly further comprises a drive motor disposed in said vehicle and operable to drive said propeller in said first direction whereupon said ramp second surface engages said pivotally movable flap and continues there by, such that rotation of said propeller in said first direction is unimpeded by said ramp and flap engagement.

6. The assembly in accordance with claim 3 wherein said flap comprises a hinge member pivotally mounted on a pin disposed in said tail cone ring, and a spring biasing said hinge member toward a position wherein said hinge member is engageable by said ramp.

7. The assembly in accordance with claim 6 wherein said flap further comprises an elastomeric pad fixed thereto and engageable with said ramp second surface.

8. The assembly in accordance with claim 6 wherein said ramp further comprises an elastomeric pad fixed to said ramp second surface.

9. A counter-rotation preventing assembly for a rotating vehicle propeller, said assembly comprising:

a circular shroud fixed to outboard tips of blades of said propeller;

a tail cone ring fixed to said vehicle and surrounding said shroud;

a ramp disposed on an inside surface of said tail cone ring; and a pivotally movable flap mounted on an outside surface of said shroud;

said ramp and said flap being engageable and configured to permit rotation of said shroud, and thereby said propeller, in a first direction, and to prevent rotation of said shroud, and thereby said propeller, in a second direction.

10. The assembly in accordance with claim 9 wherein said ramp comprises a saw-tooth configured ramp.

11. The assembly in accordance with claim 10 wherein said ramp includes a first surface extending substantially radially inwardly from said tail cone ring, and a second surface inclined from an outer end of said first surface to said inside surface of tail cone ring.

12. The assembly in accordance with claim 11 wherein during fluid motion about said vehicle, said propeller is urged in said second direction, whereupon said flap engages said ramp first surface to stop rotative movement of said shroud and said propeller.

13. The assembly in accordance with claim 11 wherein said assembly further comprises a drive motor disposed in said vehicle and operable to drive said propeller in said first direction, whereupon environmental flow forces act on said pivotally movable and prevent said flap from contacting said ramp, such that rotation of said propeller in said first direction is unimpeded by said flap and ramp engagement.

14. The assembly in accordance with claim 11 wherein said flap comprises a hinge member pivotally mounted on a pin disposed in said shroud, and a spring biasing said hinge member toward a position wherein said hinge member is engageable with said ramp.

15. The assembly in accordance with claim 14 wherein said flap further comprises an elastomeric pad fixed thereto and engageable with said ramp second surface.

16. The assembly in accordance with claim 14 wherein said ramp further comprises an elastomeric pad fixed to said ramp second surface.

* * * * *